United States Patent [19]

Rosenblum

[11] 4,028,230

[45] June 7, 1977

[54] VIBRATORY SEPARATOR SCREEN AND METHOD OF MANUFACTURE

[76] Inventor: Jesse Rosenblum, 112 Roosevelt St., Closter, N.J. 07624

[22] Filed: Apr. 2, 1975

[21] Appl. No.: 564,446

[52] U.S. Cl. ..... 209/403; 209/405; 140/109; 101/127.1; 101/128.4

[51] Int. Cl.[2] ..... B07B 1/48

[58] Field of Search ..... 209/403, 405, 408, 319; 101/127, 127.1, 128.4; 140/108, 109; 160/371, 378

[56] References Cited

UNITED STATES PATENTS

| | | | |
|---|---|---|---|
| 1,685,942 | 10/1928 | Deister | 209/403 X |
| 2,015,087 | 9/1935 | Rafton | 209/403 |
| 2,217,920 | 10/1940 | Roubal | 209/403 |
| 2,832,407 | 4/1958 | Tracy | 160/371 |
| 2,864,500 | 12/1958 | Miller | 209/403 |
| 3,070,230 | 12/1962 | Peterson | 209/403 X |
| 3,081,874 | 3/1963 | Corbin | 209/403 X |
| 3,126,332 | 3/1964 | Selete | 209/408 |
| 3,243,042 | 3/1966 | Moulton | 209/403 |
| 3,455,367 | 7/1969 | Le Tante | 160/371 |

FOREIGN PATENTS OR APPLICATIONS

| | | | |
|---|---|---|---|
| 784,916 | 5/1935 | France | 209/403 |

*Primary Examiner*—Frank W. Lutter
*Assistant Examiner*—Ralph J. Hill
*Attorney, Agent, or Firm*—Hubbell, Cohen, Stiefel & Gross

[57] ABSTRACT

An improved vibratory separator screen in which a wire mesh having least a first pair of opposed end portions each comprising a reinforced edge strip tensioned to a surrounding frame comprises a reinforcing spline member located adjacent each of the opposed end portions with the spline adjacent opposed ends portions being completely encapsulated, such as with cured vulcanized rubber, to fixedly secure the spline member to the adjacent opposed end portion with the mesh at a desired tautness for providing a substantially evenly tensioned mesh when tensioned to the surrounding frame. The completely encapsulated spline adjacent opposed end portions comprise the reinforced edge strips which each have sealed end points. These encapsulated opposed end portions may be provided on all sides of the wire mesh with the reinforced edge strips formed thereby having through holes provided directly through the completely encapsulated spline adjacent opposed end portions to provide eyelets for tensioning the mesh to the surrounding frame.

17 Claims, 8 Drawing Figures

VIBRATORY SEPARATOR SCREEN AND METHOD OF MANUFACTURE

BACKGROUND OF THE INVENTION

1. Field of the Invention

The invention relates to vibratory separator screens.

2. Description of the Prior Art

Vibratory separator screens, such as ones in which wire meshes of metal or textile cloth are mounted to metal hook appurtenances on one pair of opposed sides or edges of the mesh or to grommets on both pairs of opposed sides or edges of the mesh are well known, such as the type commercially available from the W. S. Tyler Co. and sold under the designations Tyler Type "AX" Hook Strip, Tyler Type "C" hook Strip, Tyler Type "CX" Hook Strip and Tyler Type "E" Hook Strip. Most prior art screens of this type are made by folding one piece or two pieces of metal in such a manner as to sandwich the cloth between such members, this being the manner of manufacture of the aforementioned Tyler vibrating screens. In such prior art screens, inserts of fabric, rubber, or fine metal mesh are normally added to prevent the abrasion of the screen on the leading edges of the metal strips with spotwelds or rivets being utilized near the leading edges of the hook or edges strip to hold the metal-cloth combination together. These prior art screens, however, are prone to short life when tensioned due to the resultant uneven stress build up in the welded areas. Furthermore, materials being processed by use of these vibrating screens can get into the hook strip area which is not sealed and can thus abrade or contaminate the screen. This problem becomes particularly acute for corrosive applications in which suitable expensive materials are required for the hook strip material. These disadvantages of the prior art are overcome by the present invention.

SUMMARY OF THE INVENTION

The present invention relates to an improved vibratory separator screen and an improved method of making such a screen. A vibratory separator screen has a wire mesh having at least a first pair of opposed end portions each comprising a hook reinforced edge strip hooked to a surrounding frame, such as via the reinforced edge strip itself or through eyelets in the reinforced edge strip. The improvement comprises a reinforcing spline member, such as perforated metal strips having solid long margins or, in the case of eyelet type screens, solid metal strips through which through holes are subsequently provided, located adjacent each of the opposed end portions of the first pair and being substantially equal in longitudinal extent to the longitudinal extent of the adjacent opposed end portion of the first pair. An encapsulating medium, such as cured vulcanized rubber, RTV silicone sealant, or Silastic RTV sealant, is provided at each of the opposed end portions of the first pair and completely encapsulates the spline member and the adjacent first pair opposed end portion for fixedly securing the spline member to the adjacent opposed end portion with the mesh at a desired tautness for providing a substantially evenly tensioned mesh when hooked or tensioned to the surrounding frame. The completely encapsulated spline adjacent opposed end portions has sealed end points and comprises the hook reinforced edges by which the wire mesh is tensioned to the surrounding frame. If desired, each of the opposed end portions of the wire mesh may be folded about the adjacent reinforcing spline member before completely encapsulating the spline folded adjacent opposed end portions.

Furthermore, if desired, the spline and adjacent opposed end portions may be bent, preferably before encapsulation, although it may be done after if desired, to a desired shape to form the reinforced edge strip. If the improved screen and method of making this screen are utilized for an eyelet type screen, the opposed end portions defining the periphery of the mesh each preferably has a reinforcing spline member adjacent the respective opposed end portions along the longitudinal extent thereof with each of the spline members and adjacent opposed end portions being completely encapsulated. In this instance, the spline members are preferably solid metal strips with the eyelets being provided by through holes in each of the completely encapsulated spline adjacent opposed end portions, such as by punching through each of the completely encapsulated spline adjacent opposed end portions. In completely encapsulating the spline adjacent opposed end portions, preferably each of these spline adjacent opposed end portions is surrounded with the encapsulating medium, such as a vulcanizing rubber mixture, and thereafter cured, such as in the instance of the rubber mixture.

DETAILED DESCRIPTION OF THE PREFERRED EMBODIMENT

Figure 2:
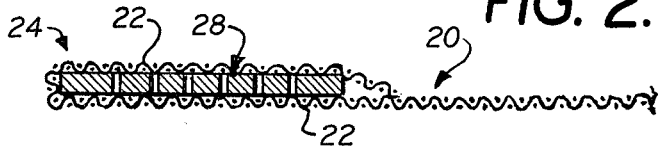
FIG. 2 is a cross sectional fragmentary view, similar to FIG. 1, of an alternative embodiment of the present invention.
Figure 3:
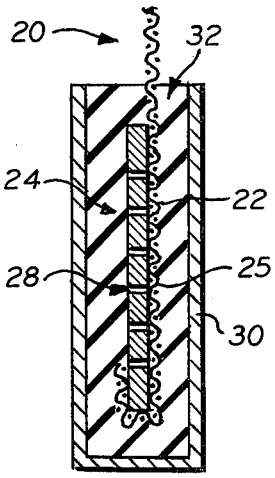
FIG. 3 is a cross sectional fragmentary view illustrative of the encapsulating step for encapsulating the embodiment illustrated in FIG. 1 in accordance with the improved method of the present invention.
Figure 4:
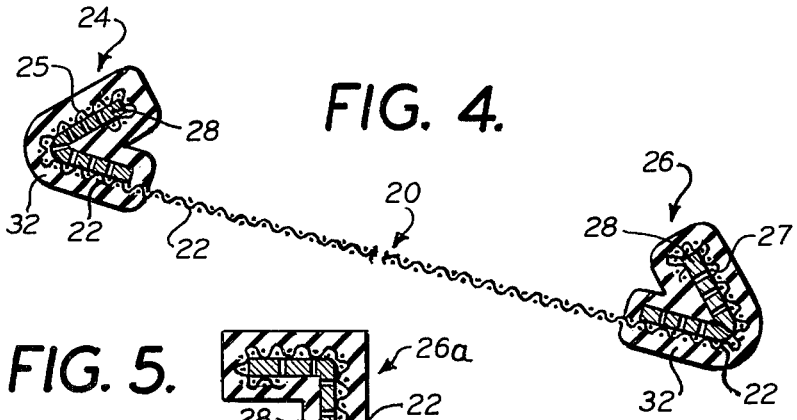
FIG. 4 is a cross sectional view of an improved vibratory separator screen in accordance with the present invention.

Referring now to the drawings in detail, FIGS. 1–5 illustrate the preferred improved vibratory separator screen of the present invention (FIG. 4), generally referred to by the reference numeral 20, and its preferred improved method of manufacture. Referring initially to FIG. 4, the improved preferred vibratory separator screen 20 of the present invention preferably comprises a foraminous wire cloth 22 of desired mesh, such as a metal or textile cloth, which is conventionally mounted or tensioned to a surrounding frame (see FIG. 6 by way of example) via conventional hooking to provide the vibratory separator screen 20 with the mesh at a desired tautness or tension. As in conventional vibratory separator screens, this hooking may be accomplished via edge strips 24 and 26 located, for example, at one pair of opposed end portions 25, 27 of the wire mesh 22. The improvement in the present invention is associated with the particularly reinforced edge strips 24 and 26 provided and the manner of providing these reinforced edge strips 24 and 26.

Figure 1:
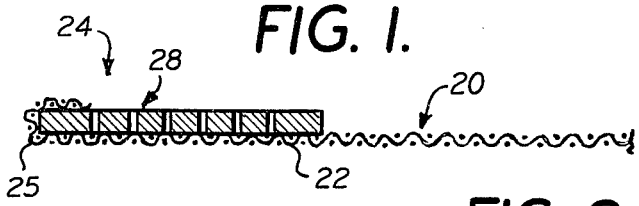
FIG. 1 is a cross sectional fragmentary view of the improved vibratory separator screen of the present invention prior to encapsulation thereof in accordance with the preferred improved method of the present invention.

Referring now to FIG. 1, which illustrates, by way of example, one of the opposed end portions 25 at which a reinforced edge strip, such reinforced edge strip 24 is to be provided, a reinforcing spline member 28, such as a conventional perforated metal strip having solid long margins with a desired gauge and width dependent upon the amount of the reinforcement desired, is placed adjacent the opposed end portion 25 at which the reinforced edge strip 24 is to be formed. Preferably, the spline 28 has substantially the same longitudinal extent as the opposed end portion 25. As shown and preferred in FIG. 1, the wire mesh 22 at this opposed end portion 25 may merely be placed beneath the spline 28 or, as illustrated in FIG. 2, may be folded over the spline 28. As presently preferred, the wire mesh 22 is folded over the spline 28 as illustrated in FIG. 2 although the arrangement of FIG. 1 is satisfactory. Furthermore, it is presently preferred that the spline 28 be tackwelded to the opposed end portions 25 and 27 by resistance welds prior to encapsulation so as to prevent movement thereof during the encapsulating step to be described in greater detail hereinafter.

Figure 5:
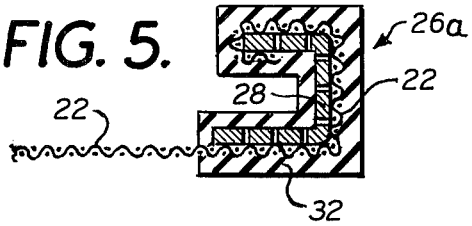
FIG. 5 is a cross sectional fragmentary view of an alternative embodiment of the reinforced edge strip portion of the improved screen in accordance with the present invention.
Figure 8:
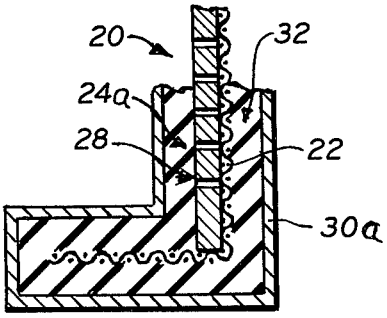
FIG. 8 is a cross sectional view similar to FIG. 3 of an alternative method of providing a reinforced edge strip by encapsulation in accordance with the improved method of the present invention.

Referring now to FIG. 3, the improved encapsulating step of providing the reinforced edge strips 24 and 26 of the present invention for the vibratory separator screen 20 is shown. Each of the sides of the screen 20 having associated reinforcing spline members 28 tackwelded thereto is preferably individually placed in a container, such as conventional mold container 30 whose interior dimensions are selected to be substantially equivalent to the exterior dimensions of the desired reinforced edge strips 24 and 26. This mold 30 is preferably a conventional mold in which curing of an encapsulating medium 32 may occur. The desired encapsulating medium 32, such as preferably a vulcanizing rubber mixture, such as Silastic RTV sealant by Dow Corning or RTV silicone sealant by General Electric, or any other suitable rubber or plastic encapsulating compound, is then poured into the mold 30 to the desired height sufficient to completely surround the spline 28 and the adjacent opposed end portion 25 of the mesh 22 and allowed to cure in conventional fashion. After curing, the molded encapsulating medium covered spline-mesh end portions 28–25 is conventionally removed from the mold 30 to provide a completely encapsulated spline adjacent opposed mesh end portion 28–25. This completely encapsulated portion 28–25 may then preferably be conventionally formed on a brake or bender to the desired form to form the reinforced edge strips 24 and 26 to properly stretch the vibrating screen 20 when it is mounted in conventional fashion in a surrounding frame, such as in a shaker apparatus. For example, as illustrated in FIG. 4, the completely encapsulated spline-mesh end portions 28–25 and 28–27 may be bent, such as at an angle of 45°, after curing to provide the reinforced edge strips illustrated in FIG. 4. In addition, if desired, as illustrated in FIG. 5, they may be bent to provide any other desired reinforced edge strip, such as bending at an angle of 90°, to provide the reinforced edge strip **26*a* shown by way of example in FIG. 5. Furthermore, if desired, and as illustrated in FIG. 8, the mesh 22 may be bent before curing, and inserted in a mold 30*a* of desired configuration, to form the reinforced edge strip 24*a* of desired configuration during the encapsulating or curing step without the necessity of subsequently having to bend the encapsulated spline-mesh 28–25 as may be required in the arrangement previously described with reference to FIG. 3. Apart from the configuration of the mold 30*a* in FIG. 8, the encapsulating step is identical with that previously described with reference to FIG. 3. Similarly, with respect to FIG. 2, the arrangement in which the mesh 22 is folded over the spline 28 is preferably encapsulated in the same manner as previously described with reference to FIG. 3 or FIG. 8.**

Figure 6:
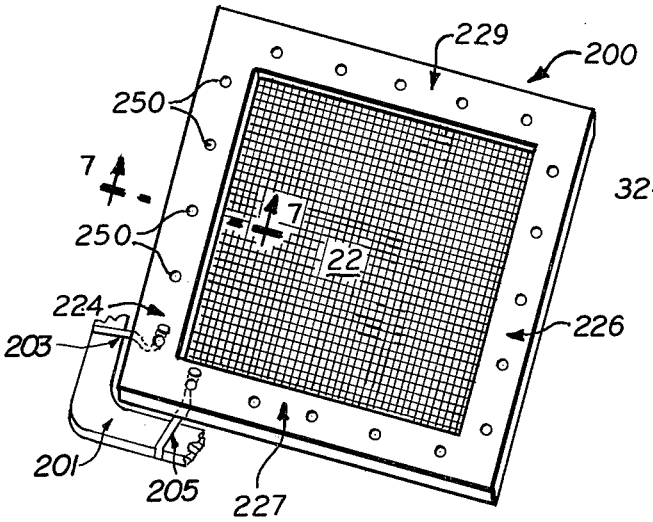
FIG. 6 is a plan view of an improved eyelet type vibratory separator screen in accordance with the present invention including; a fragmentary view of the tensioning thereof to a surrounding frame.
Figure 7:
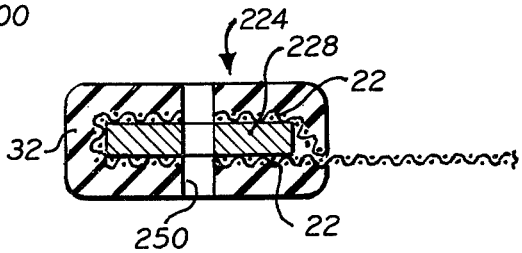
FIG. 7 is a cross sectional fragmentary view of the screen embodiment shown in FIG. 6 taken along lines 7—7 in FIG. 6.

Now referring to FIGS. 6 and 7, which illustrate an improved eyelet type vibratory separator screen 200, the screen 200 is preferably substantially provided in the same manner as previously described above with reference to the provision of vibratory separator screen 20 with the exceptions that the spline member 228 is preferably a solid metal strip as opposed to the perforated strip 28 previously described with reference to screen 20, that the entire surrounding periphery of the screen 200 is preferably encapsulated and provided with reinforced edge strips 224, 226, 227 and 229 and that eyelet holes 250 are provided in the reinforced edge strips 224, 226, 227 and 229 for conventionally hooking the screen 200 to the surrounding frame 201, such as via conventional tension means, such as hooks 203, 205, to provide the desired tautness or tension to the screen 200. The screen 200 preferably comprises a foraminous wire cloth 22 such as previously described with reference to screen 20, with reinforced edge strips 224, 226, 227 and 229 preferably being provided in the same manner as previously described with reference to FIG. 3. As shown and preferred in FIG. 7, the reinforced edge strips, one of which 224 is shown by way of example in FIG. 7, each preferably have the wire mesh 22 completely folded over the adjacent solid metal strip or spline 228 and overlapped on to itself although, if desired, the wire mesh 22 need not be folded over the spline or strip 228 but may merely underlie it as in the arrangement illustrated in FIG. 1. After the encapsulated reinforced edge strips, such as reinforced edge strip 224, are completely encapsulated, such as by curing in a conventional mold 30, or, if desired, in a mold arranged to completely surround the periphery of the mesh 22, through holes 250 are then provided in desired locations in each of the reinforced edge strips 224, 226, 227 and 229 to provide eyelets through which the screen 200 may be hooked to a surrounding frame 201, such as in a shaker apparatus, in conventional fashion to tension the screen 200 to its desired tautness. These through holes, if desired, may be provided by punching or drilling through the completely encapsulated spline-mesh 228–22 end portions.

By utilizing the preferred method and improved vibratory separator screen of the present invention, the associated reinforced edge strips are securely fixedly bounded to the mesh and splines creating an evenly tensioned completely sealed product. In addition, the improved method of the present invention can be readily adapted to all types of screens requiring stiffness or restraining such as covered or bolted leaves used in vacuum or pressure filtration.

It is to be understood that the above described embodiments of the invention are merely illustrative of the principles thereof and that numerous modifications of the invention may be derived within the spirit and scope thereof, such as by fastening of the spline to the screen by sewn stitching in place of spotwelds for textile cloth screens or wire ties or some other conventional fastening means other than tackwelding for fastening the spline to the adjacent screen end portion before encapsulation.

What is claimed is:

1. In a vibratory separator screen in which a wire mesh has at least a first pair of opposed wire mesh edges having a corresponding first pair of opposed end portions at said wire mesh edges each comprising a reinforced edge strip capable of being tensioned to a surrounding frame, the improvement comprising a reinforcing spline member located adjacent each of said opposed end portions of said first pair and being substantially equal in longitudinal extent thereto and a mold cured encapsulating medium at each of said opposed end portions of said first pair completely surrounding said spline member and said adjacent first pair opposed end portion for forming a reinforced molded member at each of said opposed end portions, said spline member being fixedly secured to said adjacent opposed end portion in said molded member with said mesh at a desired tautness for providing a substantially evenly tensioned mesh when tensioned to said surrounding frame, said completely encapsulated molded member comprising said reinforced edge strip, said reinforced edge strip having sealed end points and comprising means for enabling said wire mesh to be tensioned to said surrounding frame for providing said substantially evenly tensioned mesh, said spline reinforced molded members maintaining stiffness of said wire mesh edges and controlling spillage over said edges.

2. An improved screen in accordance with claim 1 wherein each of said opposed end portions of said first pair is folded about said adjacent reinforcing spline member, said encapsulating medium completely surrounding and encapsulating said spline folded adjacent opposed end portions in said spline reinforced molded members.

3. An improved screen in accordance with claim 1 wherein each of said spline members includes a plurality of apertures therein.

4. An improved screen in accordance with claim 1 wherein said encapsulating medium is cured vulcanized rubber.

5. An improved screen in accordance with claim 1 wherein said wire mesh further has a second pair of opposed end portions intersecting said first pair of opposed end portions to surround said wire mesh in end to end relationship, each of said second pair end portions comprising a reinforced edge strip capable of being tensioned to said surrounding frame, a reinforcing spline member being located adjacent each of said opposed end portions of said second pair and being substantially equal in longitudinal extent to the longitudinal extent of said second pair adjacent opposed end portion, and a mold cured encapsulating medium at each of said second pair end portions completely surrounding said spline member and said second pair adjacent opposed end portion for forming a reinforced molded member at each of said second pair opposed end portions, said spline member being fixedly secured to said second pair adjacent opposed end portion in said molded member with said mesh at said desired tautness for providing a substantially evenly tensioned mesh when tensioned to said surrounding frame, said completely encapsulated second pair molded member comprising said second pair reinforced edge strip, said second pair reinforced edge strip having sealed end points and comprising means for enabling said wire mesh to be tensioned to said surrounding frame for providing said substantially evenly tensioned mesh, said spline reinforced second pair molded members maintaining said stiffness and said spillage control, said tension enabling means in each of said reinforced edge strips comprising through holes provided directly through said spline reinforced molded members, said through holes providing eyelets for tensioning said mesh to said frame.

6. An improved screen in accordance with claim 5 wherein said encapsulating medium is cured vulcanized rubber.

7. In a method of making a vibratory separator screen from a wire mesh having at least a first pair of opposed wire mesh edges having a corresponding first pair of opposed end portions at said wire mesh edges each comprising a reinforced edge strip which is capable of being tensioned to a surrounding frame, the improvement comprising the steps of providing a reinforcing spline member adjacent each of said opposed end portions of said first pair along the longitudinal extent of said opposed end portion for substantially said longitudinal extent, placing said spline reinforced opposed end portions in a mold container means therefor for providing a desired mold configuration, and pouring an encapsulating medium into said mold container means to a sufficient level for completely surrounding said spline member reinforced opposed end portions with said encapsulating medium, curing said encapsulating medium surrounded spline reinforced opposed end portions in said mold container means for a sufficient interval to fixedly secure said spline member to said adjacent opposed end portions in a completely surrounded encapsulated molded member formed from such encapsulating medium with said mesh at a desired tautness for providing a substantially evenly tensioned mesh when tensioned to said surrounding frame, removing said cured molded member from said mold container means, and providing said reinforced edge strip from said removed cured molded member, said completely encapsulated molded member comprising said reinforced edge strip, said reinforced edge strip having sealed end points and comprising means for enabling said wire mesh to be tensioned to said surrounding frame for providing said substantially evenly tensioned mesh.

8. An improved method in accordance with claim 7 further comprising the step of folding each of said opposed end portions about said adjacent reinforcing spline member and thereafter placing said folded spline reinforced opposed end portions in said mold container means.

9. An improved method in accordance with claim 7 further comprising the steps of bending said spline member and said adjacent opposed end portion to a desired shape for said reinforced edge strip, said mold container means substantially conforming to said desired shape, and thereafter placing said bent shaped spline reinforced opposed end portions in said shaped mold container means.

10. An improved method in accordance with claim 1 wherein said edge strip providing step comprises the step of bending each of said removed cured molded members to a desired shape to form said reinforced edge strip.

11. An improved method in accordance with claim 7 wherein said wire mesh further has a second pair of opposed end portions each comprising a reinforced edge strip, said first and second pairs of opposed end portions intersecting each other in end to end relation for defining the periphery of said mesh, said spline member providing step comprises the further step of providing a reinforcing spline member adjacent each of said opposed end portions of said second pair along the longitudinal extent thereof, said placing step comprises the further step of placing said spline reinforced opposed end portions of said second pair in said mold container means, said pouring step comprises the further step of pouring said encapsulating medium into said mold container means to a sufficient level for completely surrounding said spline member reinforced opposed end portions of said second pair with said encapsulating medium, said curing step further comprises the step of curing said encapsulating medium surrounded spline reinforced opposed end portions of said second pair in said mold container means for a sufficient interval to fixedly secure said spline member to said adjacent opposed end portions of said second pair in a completely surrounded encapsulated molded member formed from said encapsulating medium with said mesh at said desired tautness when tensioned to said surrounding frame for providing said substantially evenly tensioned mesh, said removing step further comprises the step of removing said second pair molded member from said mold container means and said edge strip providing step comprises the step of providing said reinforced edge strip from said removed second pair molded members, said completely encapsulated molded member comprising said reinforced edge strip, said reinforced edge strip having sealed end points and comprising means for enabling said wire mesh to be tensioned to said surrounding frame for providing said substantially evenly tensioned mesh.

12. An improved method in accordance with claim 11 wherein said pouring step comprises the further step of completely surrounding each of said spline adjacent opposed end portions with a vulcanizing rubber mixture encapsulating medium and said curing step comprises the step of thereafter curing said rubber mixture to form each of said molded members.

13. An improved method in accordance with claim 11 wherein said further spline providing step further comprises the step of initially fixedly securing said reinforcing spline member in said adjacent relation with each of said opposed end portions of said second pair before placing said spline reinforced opposed end portions of said second pair in said mold container means.

14. An improved method in accordance with claim 11 comprising the further step of providing a through hole in each of said molded members for providing eyelets for tensioning said mesh to said frame for providing said tension enabling means.

15. An improved method in accordance with claim 14 wherein said through hole providing step further comprises the step of providing said through holes by punching through each of said molded members.

16. An improved method in accordance with claim 7 wherein said pouring step comprises the further steps of completely surrounding each of said spline adjacent opposed end portions with a vulcanizing rubber mixture encapsulating medium and said curing step comprises the step of thereafter curing said rubber mixture to form each of said molded members.

17. An improved method in accordance with claim 7 wherein said spline providing step further comprises the step of initially fixedly securing said reinforcing spline member in said adjacent relation with each of said opposed end portions before placing said spline reinforced opposed end portions in said mold container means.

* * * * *